US008414219B2

(12) United States Patent
Lickel et al.

(10) Patent No.: US 8,414,219 B2
(45) Date of Patent: Apr. 9, 2013

(54) CONCRETE TROWEL TRANSPORT SYSTEM

(75) Inventors: Timothy J. Lickel, Sussex, WI (US); Scott Grahl, St. Cloud, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 0 days.

(21) Appl. No.: 12/976,353

(22) Filed: Dec. 22, 2010

(65) Prior Publication Data

US 2012/0163912 A1 Jun. 28, 2012

(51) Int. Cl.
*E01C 19/22* (2006.01)

(52) U.S. Cl. ..... 404/112; 404/85

(58) Field of Classification Search ..... 404/85, 404/112; 280/43.13, 43.16
See application file for complete search history.

(56) References Cited

U.S. PATENT DOCUMENTS

| | | | | | |
|---|---|---|---|---|---|
| 2,621,568 | A | | 12/1952 | Fletcher | |
| 2,898,826 | A | | 8/1959 | Livermont | |
| 2,983,203 | A | | 5/1961 | Fletcher | |
| 3,578,352 | A | * | 5/1971 | Heine | 280/43.23 |
| 3,901,616 | A | | 8/1975 | Greening | |
| 4,113,403 | A | | 9/1978 | Tertinek et al. | |
| 4,126,332 | A | * | 11/1978 | Johansson | 280/683 |
| 4,710,055 | A | | 12/1987 | Maass et al. | |
| 5,088,799 | A | | 2/1992 | Redmon et al. | |
| 5,238,323 | A | | 8/1993 | Allen et al. | |
| D340,340 | S | | 10/1993 | Allen | |
| 6,059,299 | A | | 5/2000 | Rust | |
| 6,347,907 | B1 | | 2/2002 | Halstead | |
| D465,897 | S | | 11/2002 | Smith | |
| D518,070 | S | | 3/2006 | Schennach | |
| 7,204,657 | B2 | | 4/2007 | Jackson | |
| 7,771,139 | B2 | | 8/2010 | Grahl | |
| 2005/0141962 | A1 | * | 6/2005 | Snyder et al. | 404/112 |
| 2009/0047070 | A1 | * | 2/2009 | Grahl | 404/101 |

OTHER PUBLICATIONS

Dynapack, BG76 Power Trowels (3 pages).
Multiquip, Ride-On Power Trowels, Hydrostatic and Mechanical Drive Models (2 pages).
Photograph of Barikell Prior Art Wheel Kit (1 page).
Whiteman Competitive Wheel Kit (1 page).

* cited by examiner

*Primary Examiner* — Robert Pezzuto
*Assistant Examiner* — Matthew D Troutman
(74) *Attorney, Agent, or Firm* — Boyle Fredrickson, S.C.

(57) ABSTRACT

A self-propelled concrete finishing trowel has an integrated transport system that allows the towel to be moved from location to location. The transport system includes a pair of spaced wheel assemblies, each including a pair of wheels that are connected to a frame of the trowel. The wheels of each respective wheel assembly are connected to one another via a powered actuator such as a double acting hydraulic cylinder. The powered actuator is actuatable to raise and lower the first and second wheels from a stowed position in which the wheels are located above the ground and the blades are supported on the ground to a deployed position in which the wheel are supported on the ground and the blades are raised from the ground.

5 Claims, 5 Drawing Sheets

CONCRETE TROWEL TRANSPORT SYSTEM

BACKGROUND OF THE INVENTION

1. Field of the Invention

The invention relates generally to concrete finishing trowels and, more particularly, to a transport system for a powered finishing trowel. The invention additionally relates to a concrete finishing trowel, such as a riding trowel, having an integrated transport system that enables wheeled transport of the trowel within a worksite and to and from a worksite.

2. Description of the Related Art

A variety of machines are available for smoothing or otherwise finishing wet concrete. These machines range from simple hand trowels, to walk-behind trowels, to self-propelled riding trowels. Regardless of the mode of operation of such trowels, the powered trowels generally include one to three rotor assemblies that rotate relative to the concrete surface.

Riding concrete finishing trowels can finish large sections of concrete more rapidly and efficiently than manually pushed or guided hand-held or walk behind finishing trowels. Riding concrete finishing trowels typically include a frame having a cage that typically encloses two, and sometimes three or more, rotor assemblies. Each rotor assembly includes a driven shaft and a plurality of trowel blades mounted on and extending radially outwardly from the bottom end of the driven shaft. The driven shafts of the rotor assemblies are driven by one or more engines mounted on the frame and typically linked to the driven shafts by gearboxes of the respective rotor assemblies.

The weight of the finishing trowel, including the operator, is transmitted frictionally to the concrete surface by the rotating blades, thereby smoothing the concrete surface. The pitch of individual blades can be altered relative to the driven shafts via operation of a lever and/or linkage system during use of the machine. Such a construction allows the operator to adjust blade pitch during operation of the power trowel. As is commonly understood, blade pitch adjustment alters the pressure applied to the surface being finished by the machine. This blade pitch adjustment permits the finishing characteristics of the machine to be adjusted. For instance, in an ideal finishing operation, the operator first performs an initial "floating" operation in which the blades are operated at low speeds (on the order of about 30 rpm) but at high torque. Then, the concrete is allowed to cure for another 15 minutes to one-half hour, and the machine is operated at progressively increasing speeds and progressively increasing blade pitches up to the performance of a finishing or "burning" operation at the highest possible speed—preferably above about 150 rpm and up to about 200 rpm.

During use, the riding trowel is supported by the engagement between the blades and the underlying concrete material. The blades may rest directly on the concrete or on pans. To some extent, the weight of the machine assists the finishing process.

Although the weight of the machine can be beneficial for providing efficient, robust, and powerful trowel operation, the weight of the machine is also detrimental to non-use transportation of the trowel, i.e. while moving the trowel within the worksite or to or from a worksite without operating the blades. Commonly, supplemental equipment, such as a skid loader, a backhoe, or the like, is utilized to move the machine to and from a work surface. Some concrete finishing trowels are fitted with lift points for attachment to a chain for this purpose. These machines experience difficulty in moving the trowel in certain work environments. For instance, for large slab on grade jobs where a number of pours are required to complete a floor, the green concrete is unable to support the heavy machinery for several weeks after a pour. Forklifts and similar devices therefore cannot access the trowels for transport.

Further, forklifts and other prior art transport systems used in lieu of on-board wheel transports are typically constructed to support weights of approximately between 1600-2300 pounds; however, concrete finishing trowels may weigh in excess of 2300 pounds. For instance, some known trowels may weigh as much as 2800 pounds, making the prior art transport systems unsuitable for use therewith. Alternatively, when no such equipment is available or the trowel must be used in a location which is not accessible by or otherwise cannot accommodate such equipment, two or more laborers are required to manually lift and move the machine. This is a labor intensive and physically demanding technique for moving such machines.

Previous trowel transport systems have been disclosed which include a number of wheels or casters that are securable to the frame of the trowel. These transport systems typically take the form of "wheel kits" that are sold as aftermarket accessories. The wheel kits comprise a number of wheel assemblies that are irremovably attached to the trowel. One such removable wheel kit or "dolly" is disclosed in U.S. Pat. No. 5,238,323 to Allen et al. The wheel kit disclosed in the Allen '323 patent includes a pair of wheel assemblies secured to generally opposite sides of the exterior of the cage of a riding trowel. A separate jack is provided for each wheel assembly so that each jack independently raises and lowers a separate wheel assembly relative to the frame. When lowered, the wheels support the trowel such that a single user can move the entire trowel by simply pushing or pulling it in an intended direction.

Although such systems enhance the mobility of power trowels, they are not without their drawbacks.

For instance, because the wheel assemblies of the Allen '323 patent are located outboard of the cage, they increase the overall footprint of the machine. Increasing the footprint of the machine increases the space occupied by the machine. Accordingly, it may prevent the machine from being transported in the beds of some trucks without removing the wheel assemblies. Increasing the footprint of the machine also detracts from a user's ability to position the machine close to the perimeter of an area to be worked (commonly referred to as a "pour area") or an obstacle in or adjacent to a pour area. This limitation is problematic because users of finishing machines prefer that the machine finish as much of the pour area as possible. The areas that cannot be finished due to the interference between the wheel assemblies and the obstructions must be finished by hand, increasing the amount of hand work associated with a given pour. This problem can be avoided only by removing the wheel assemblies prior to commencing a finishing operation.

Transport systems such as the one disclosed in U.S. Pat. No. 5,238,323 are also relatively inefficient. To raise the machine, the operator must manually operate two separate jacks on opposite sides of the machine. In addition, unless care is taken to operate both jacks the same amount, one side of the machine may be higher than the other during transport, reducing the stability and maneuverability of the machine. Moreover, the wheel kit of the '323 patent is not integrated into the trowel but, rather, is coupled to the machine as an accessory that typically is installed and removed at the worksite. Like any accessory, these wheel kits are susceptible to being lost, left behind, or damaged at job sites because they are set aside when not in use.

U.S. Pat. No. 7,771,139 to Grahl discloses a transport system in which two or more spaced wheels are concurrently movable by manual manipulation of a single lifting jack to adjust the position of the wheels relative to the blades of the finishing machine. The wheel assemblies of the '139 patent also are located inside the "footprint" of the machine, permitting the machine to be operated with the wheel assemblies installed without interference from obstructions in or adjacent the pour area. They also are integrated into the remainder of the machine. While the device of the '139 patent is thus an improvement over the '323 patent, the presence of even a single jack may prove to be cumbersome during maintenance of the trowel. Manually operating a jack also is labor intensive. The need to manually actuate the jack or other lifting mechanisms of traditional wheel kits is especially problematic with large, hydraulically powered trowels. These trowels typically have an internal combustion engine coupled to the rotor assemblies by a hydrostatic drive system including a pump and multiple hydraulic motors, one of which is provided for each rotor assembly. The trowels are steered by tilting the rotor assemblies using hydraulic cylinders. Each rotor assembly may have a diameter of 5 feet, rendering the trowel over 10 feet long. The combined weight of the trowel and the operator may exceed 2,500 lbs—triple that of traditional manually steered powered trowels having a mechanical gearbox coupling each rotor assembly to the internal combustion engine. This dramatic difference in weight renders traditional manually actuated jacks and their associated wheel kit components ill-suited for use with hydraulically powered trowels.

Accordingly, there is also a need for a wheeled transport system for a concrete finishing trowel that requires less effort to deploy than previously-known transport systems.

There is also a need for a trowel transport system which is integrated into the trowel and which, therefore, need not be attached to the trowel by the operators and is not at risk of damaged when removed from the trowel or of being lost.

There is also a need for an easily-deployed concrete finishing trowel transport system that does not increase the footprint of the machine. A transport system that is integrated into a powered trowel and that eliminates the need for an external lifting mechanism such as a jack is also desired.

It is further desired to provide a trowel transport system that can be implemented into a number of machine configurations as well as one that is relatively simple to operate, inexpensive to produce, and simple to maintain.

SUMMARY OF THE INVENTION

The present invention provides a power concrete finishing trowel transport system that meets one or more of the above-identified needs. A transport system according to one aspect of the invention includes at least two of spaced wheel assemblies that are movable by actuation of one or more powered actuators to move the wheel assemblies from a raised or stowed position in which the wheels are disposed above a trowel support surface to a lowered or deployed position in which the wheels support the trowel on the support surface. Each wheel assembly may include two or more spaced wheels. In this case, a single powered actuator such as a hydraulic cylinder may be operable to deploy the wheels of each assembly. The powered actuators may be controlled concurrently by a single switch.

Another aspect of the invention is to provide a power concrete finishing trowel that meets the first principal aspect and that is simple to operate, does not substantially increase the weight of the finishing machine, and is inexpensive.

Yet another aspect of the invention is to provide a power concrete finishing trowel with a transport system that meets one or more of the first and second aspects and that does not otherwise increase the footprint of the finishing machine.

Still another aspect of the invention is to provide a power concrete finishing trowel transport system that is integrally formed with the concrete finishing trowel. In a particularly preferred configuration, the transport system includes two wheel assemblies disposed at the front and rear of the machine, respectively. Each wheel assembly includes a pair of wheels mounted on respective pivoting bracket assemblies, each of which is pivoted on a mount welded to or otherwise rigidly connected to a fork lift tube extending widthwise across the frame. Each set of wheels is raised and lowered by a single double acting hydraulic cylinder having a barrel connected to one of the bracket assemblies and a rod connected to the other bracket assembly. The raising and lowering of the sets of wheels is controlled by the operator via a switch interconnected with both hydraulic cylinders.

A method for satisfying one or more of the above aspects includes providing a power trowel having a frame and at least one rotor assembly that includes a rotatable shaft and a plurality of blades. The method includes actuating one or more powered actuators to move wheel assemblies from a raised or stowed position in which the wheels are above a trowel support surface to a lowered or deployed position in which the wheels support the trowel on the support surface. Two or more sets of wheels may be provided at opposite sides of the machine. In this case, the actuating step my include manipulating a single actuator such as a hydraulic cylinder to deploy the wheels of each set. The powered actuators may be controlled concurrently by a single switch.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

Figure 1:
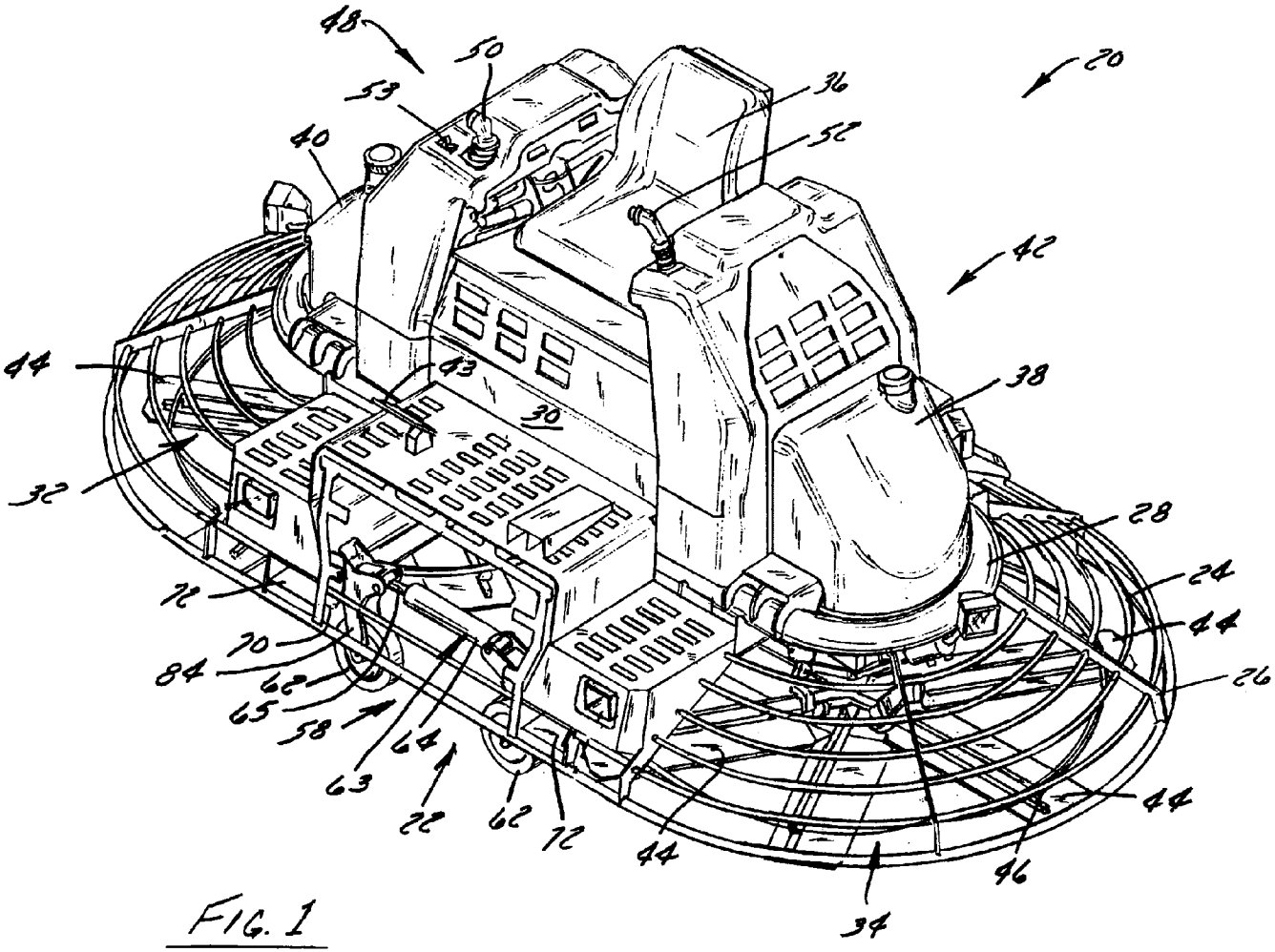
FIG. 1 is a perspective view of a riding power trowel equipped with a transport system according to present invention.

FIG. 1 shows a self-propelled riding concrete finishing trowel 20 equipped with a transport system 22 that is constructed according to a preferred embodiment of the present invention and that is positioned nearly entirely beneath the shroud or cage 24 of the trowel 20. Although shown as what is commonly understood as a riding or ride-on trowel, it is appreciated that the present invention is applicable to any powered concrete finishing trowel that cannot easily be manually moved by an operator without substantial physical effort. That is, it is conceivable that riding power trowels having configurations other than that shown, or even walk-behind trowels, could be equipped with a transport system according to the present invention.

Figure 2:
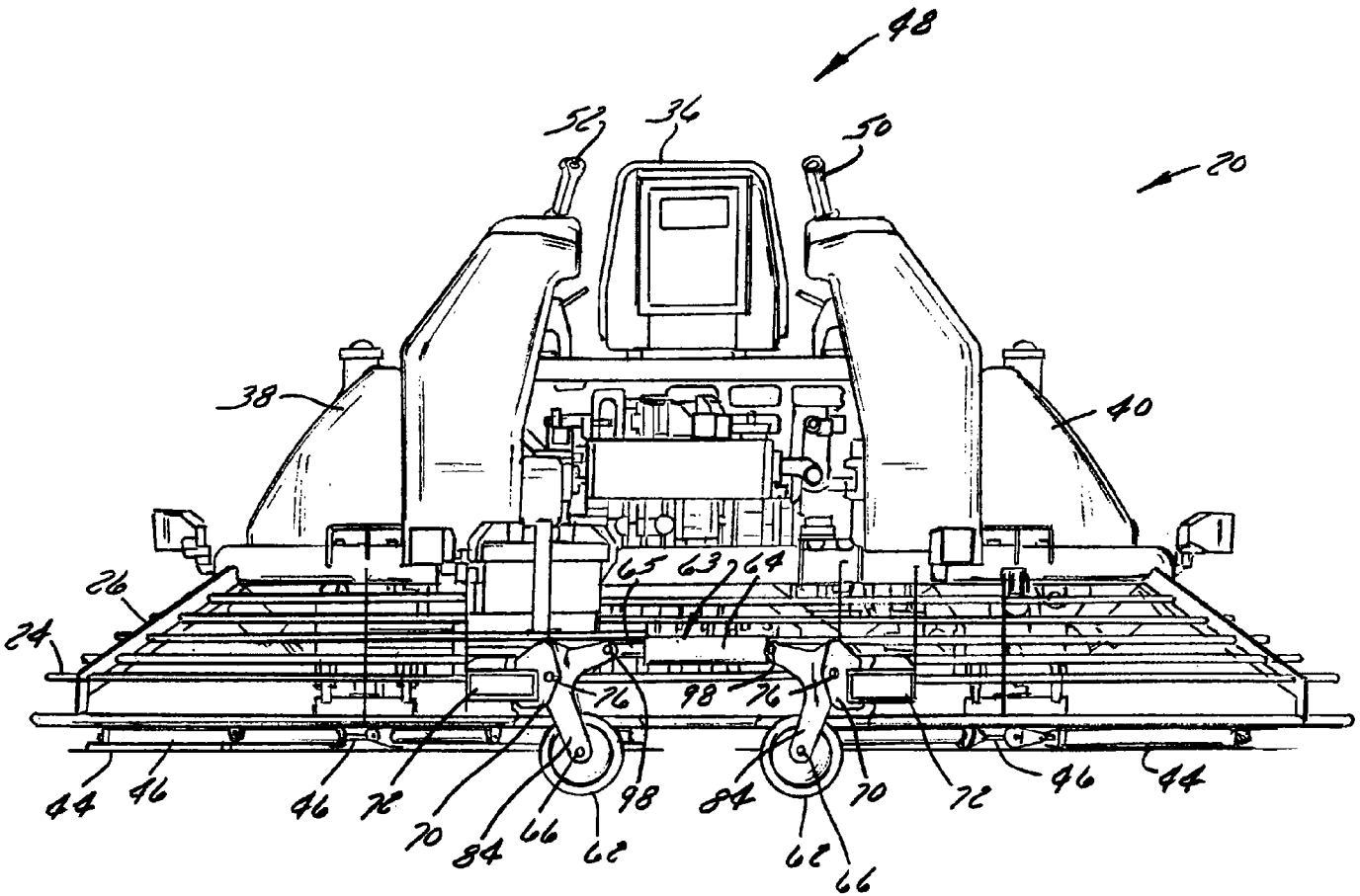
FIG. 2 is a rear elevational view of the power trowel shown in FIG. 1 with a center portion of a cage of the trowel being shown as cut away to expose a first wheel assembly of the transport system of the trowel.
Figure 3:
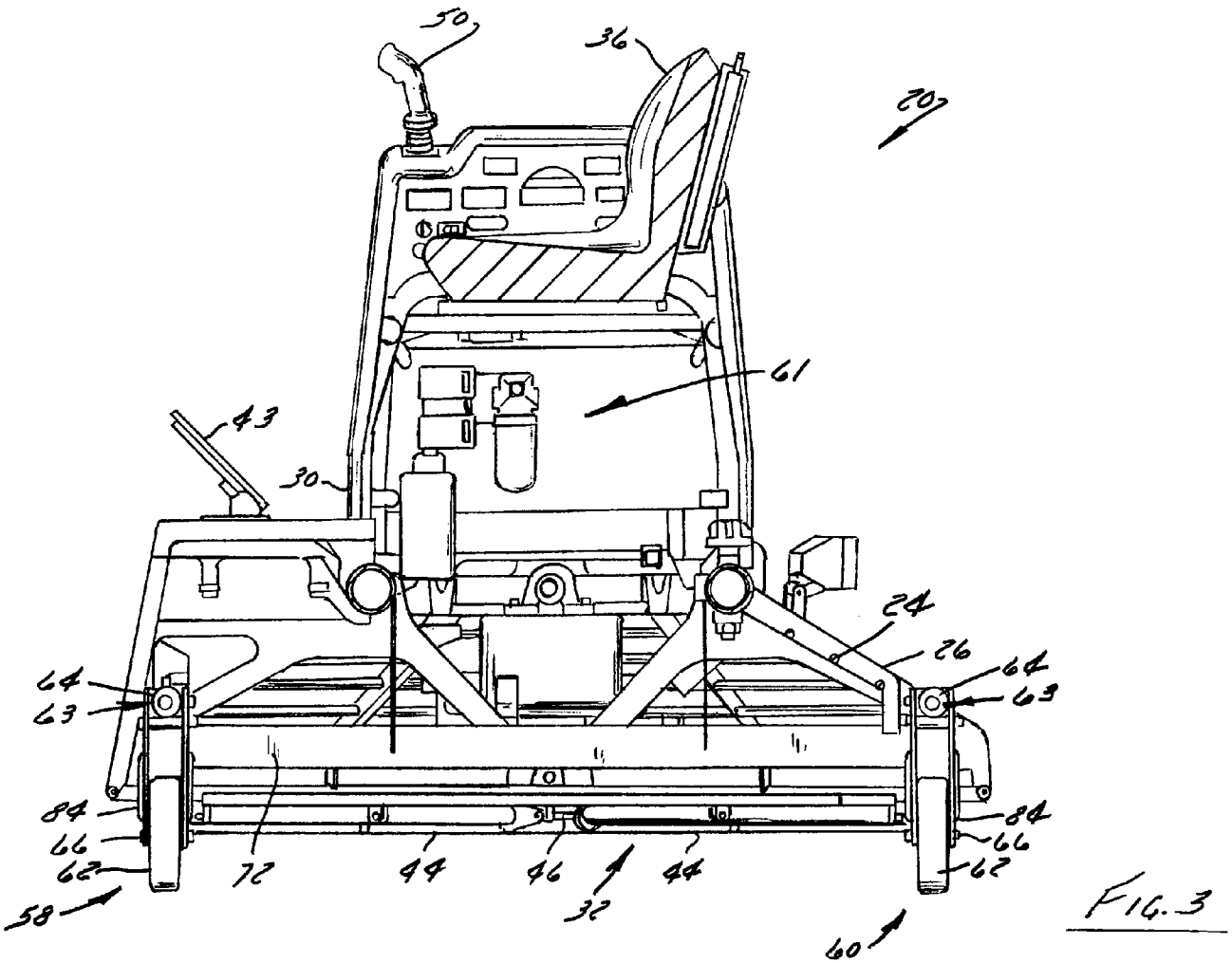
FIG. 3 is a side elevational cross-sectional view of the power trowel shown in FIGS. 1 and 2.

Referring to FIGS. 1-3, and initially to FIG. 1 in particular, concrete finishing trowel 20 in accordance with a preferred embodiment of the invention includes as its major components a rigid metallic frame 26, an upper deck 28 mounted on frame 26, an operator's platform or pedestal 30 provided on the deck, and right and left rotor assemblies 32, 34, respectively, extending downwardly from deck 28 and supporting the finishing trowel 20 on the surface to be finished.

The rotor assemblies 32 and 34 rotate towards the operator, or counterclockwise and clockwise, respectively, to perform a finishing operation. Cage 24 is positioned at the outer perimeter of trowel 20 and extends downwardly from frame 26 to the vicinity of the surface to be finished. Cage 24 generally defines a footprint of trowel 20. The pedestal 30 is positioned generally longitudinally centrally on deck 28 at a rear portion thereof and supports operator's seat 36. A fuel tank 38 is disposed adjacent the left side of pedestal 30, and a water retardant tank 40 is disposed on the right side of pedestal 30. A lift cage assembly 42, best seen in FIG. 1, is attached to the upper surface of the deck 28 beneath pedestal 30 and seat 36. Lift cage assembly 42 is used to transport power trowel 20 when supplemental equipment is available and/or for those application when manual movement of power trowel 20 is impractical, such as pours commonly associated with tall structures or loading of the machine onto raised flatbed vehicles. The trowel can also be transported by lifting it at fork tubes 72 using a forklift or by deploying the wheeled transport system 22 as discussed below.

Each rotor assembly 32, 34 includes a plurality of circumferentially-spaced blades 44 supported on a driven shaft (not shown) via radial support arms 46 and extending radially outwardly from the bottom end of the driven shaft so as to rest on the concrete surface. Both rotor assemblies 32 and 34, as well as other powered components of the finishing trowel 20, are driven by a hydrostatic drive system located under the frame. The hydrostatic drive system includes a hydrostatic pump that is powered by an internal combustion engine 61 to circulate hydraulic fluid to a pair of hydraulic drive motors, each of which drives a respective rotor assembly 32 or 34 to rotate. Operation of the hydrostatic pump is governed by a solenoid controlled electro-hydraulic proportional control valve that controls the output of the pump based on a proportional current signal generated by a foot pedal 43 and transmitted by a controller (not shown).

Referring to FIGS. 1 and 2, trowel 20 additionally includes a steering system 48 that steers trowel 20 by tilting the driven shafts of the rotor assemblies 32, 34 of trowel 20. Steering system 48 includes one, and preferably two, joysticks 50, 52. Joysticks 50, 52 are operationally coupled to rotor assemblies 32, 34 such that manipulation of joysticks 50, 52 manipulates the position of rotor assembly 32, 34 relative to a frame 26 of trowel 20, respectively. Specifically, as is typical of riding concrete finishing trowels of this type, trowel 20 is steered by tilting a portion or all of each of the rotor assemblies 32 and 34 so that the rotation of the blades 44 generates horizontal forces that propel trowel 20. The steering direction is generally perpendicular to the direction of rotor assembly tilt. Hence, side-to-side and fore-and-aft rotor assembly tilting causes trowel 20 to move forward/reverse and left/right, respectively. As described in U.S. Pat. No. 7,775,740 to Berritta, the disclosure of which is incorporated herein, the most expeditious way to effect the tilting required for steering control is by tilting the entire rotor assemblies 32 and 34, including the respective drive motors.

The wheeled transport system of this embodiment includes front and rear wheel assemblies 58, 60 located generally centrally of the frame and spaced longitudinally from one another so as to be positioned in front of and behind the operator's seat 36, respectively. They are located just inside the perimeter of the cage 24 in the illustrated embodiment but could be spaced closer to one another, if desired, to accommodate other components of the machine such as frame components, steering system components, or drive system components. In the preferred embodiment, however, they should be spaced far enough apart to prevent or at least inhibit the machine from rocking about the machine's longitudinal centerline. They also should not extend beyond the widest perimeter of the cage and, as such, should not increase the footprint of the trowel 20. It should be noted that, rather than being spaced longitudinally from one another, the wheel assemblies 58 and 60 could instead be located on opposite ends of the machine and spaced from one another laterally rather than longitudinally as in the illustrated embodiment.

The wheel assemblies 58, 60 are raised and lowered by actuation of one or more powered actuator arrangements to move the wheel or wheels of each assembly 58, 60 from a raised, stowed position in which the wheels are above a trowel support surface to a deployed position in which the wheels lift the trowel 20 from the support surface and support the trowel on the support surface. The powered actuators could comprise any powered device or combination of devices, such as linear electric actuators, that are capable of raising and lowering the wheels and the weight of the trowel 20. Hydraulic cylinders 63 currently are preferred. A switch 53 (FIG. 1) is disposed proximate to the seat 36 for actuating the hydraulic cylinders for raising and lowering the wheel or wheels of each assembly. Switch 53 may be a rocker switch or similar such switch in which positioning the switch 53 in a first position raises the wheel assemblies 58, 60 above the tops of the blades 44 and positioning the switch 53 in a second position lowers the wheel assemblies 58, 60 to engage the ground and lift and support the weight of trowel 20 for transport thereof.

Turning now to FIGS. 4-7, each wheel assembly 58, and 60 of this embodiment comprise two aligned wheels 62. Each of wheels 62 rotates about an axle 66 that extends longitudinally with respect to the trowel 20 in the illustrated embodiment but, conceivably, could extend laterally or swivel. Each wheel preferably comprises a solid tire of the type typically used on forklifts. The wheels 62 of each respective wheel assembly 58, 60 are coupled to one another by a double acting hydraulic cylinder 63 that is operable to simultaneously deploy or stow both wheels 62 of the associated wheel assembly 58 or 60. Hydraulic cylinder 63 includes a barrel 64 and a rod 65 received through the barrel 64. Rod 65 carries a piston (not shown) that divides the interior of barrel 64 into a pair of cavities (not shown) as is generally understood in the art.

Still referring to FIGS. 4-7, each of the wheels 62 is independently supported by a support assembly 68 that is coupled to the hydraulic cylinder 63 for concurrent movement of both wheels 62 of each wheel assembly 58 or 60. Each wheel assembly 58 and 60 includes a right support assembly 68*a* and a left support assembly 68*b*. Each support assembly 68*a* and 68*b* includes a mounting bracket 70*a*, 70*b* (collectively, mounting brackets 70), respectively, that is welded or otherwise connected to a fork lift tube 72 that extends longitudinally across the frame 26 of trowel 20 such that mounting brackets 70 are rigidly fixed to the trowel 20. The fork lift tubes 72 flank the lateral centerline of the trowel 20 and are spaced from one another by the standard spacing for a forklift (typically 24" to 30""). The fork lift tubes are sufficient rigid to support the entire weight of the trowel 20 when the tines or forks of a forklift engage the fork lift tubes 72 and are raised. Hence, in addition to providing a rigid support structure for the wheel assemblies 58, 60, the fork lift tubes 72 provide an independent transport mechanism for the trowel 20.

Still referring to FIGS. 4-7, each mounting bracket 70*a*, 70*b* includes a pair of side plates 71 that are arranged on opposed sides of the associated wheel 62. Each side plate 71 defines a generally C-shaped opening in which the associated lift tube 72 is received. The side plates 71 are welded to or otherwise rigidly attached to the associated lift tube 72. A pivoting bracket 84*a* or 84*b* is received between each of the side plates 71 of each of the mounting brackets 70*a* and 70*b*, respectively. Each pivoting bracket 84*a* or 84*b* includes a pair of side arms 85 coupled to one another by a central reinforcing plate 87. Apertures 74 and 90 are formed through the side plates 71 and the central portions of the side arms 85, respectively. Apertures 74 and 90 are aligned with one another and receive a pivot pin 76*a* or 76*b*. Each pivoting bracket 84*a* or 84*b* is selectively rotatable about the associate pin 76*a* or 76*b* with respect to the associated mounting bracket 70*a* or 70*b* to thereby raise and lower wheel assemblies 58, 60.

Figure 4:
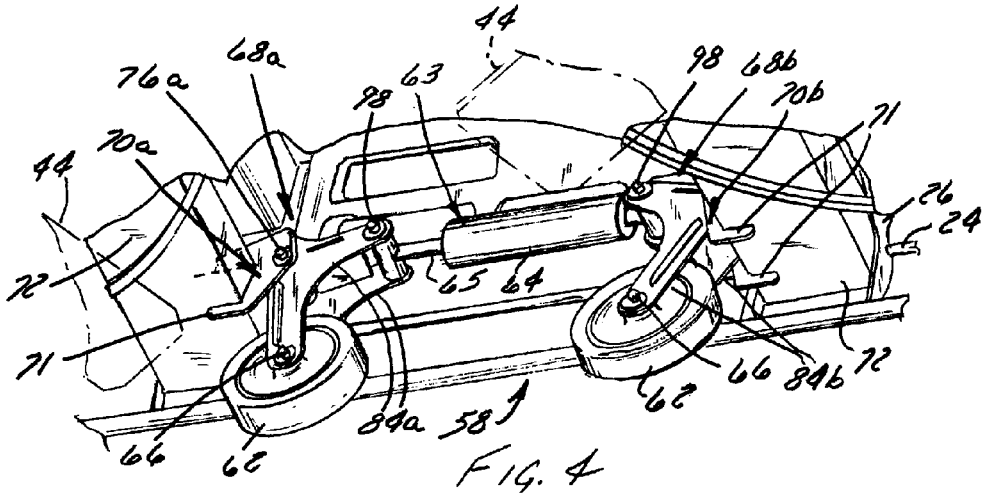
FIG. 4 is a perspective view of a portion of an underside of the trowel of FIG. 1, showing a wheel assembly and hydraulic cylinder thereof.
Figure 5:
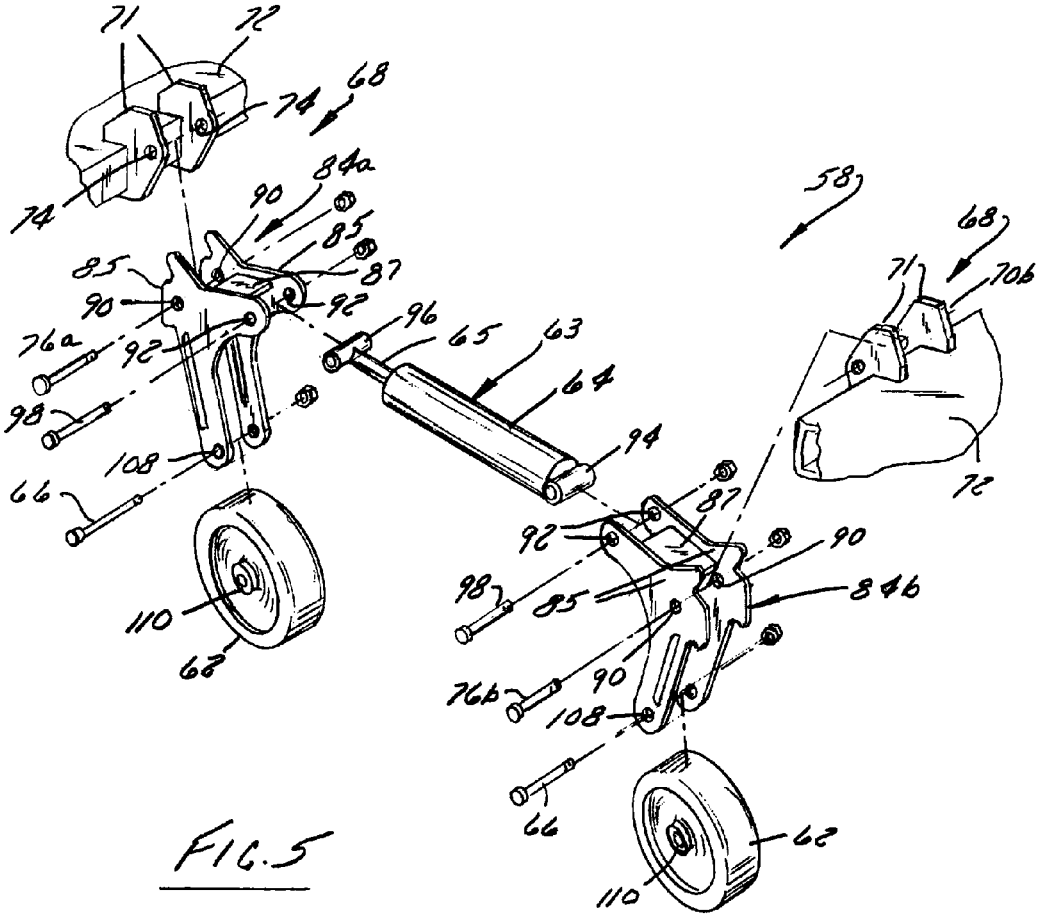
FIG. 5 is an exploded view of the transport system of FIG. 1 removed from the trowel system.

Referring particularly to FIGS. 4 and 5, each pivoting bracket 84*a* or 84*b* includes a second aperture 92 positioned for coupling the pivoting bracket 84*a* or 84*b* to the hydraulic cylinder 63. Specifically, each of wheel assemblies 58 includes a support assembly 68*a* that is coupled to rod 65 of the hydraulic cylinder and a support assembly 68*b* that is coupled to the barrel 64 of hydraulic cylinder 63. Specifically, barrel 64 includes an end tube 94 for pivotally receiving a pin 96*b* coupled to an upper end of the front right bracket 84*b*, and rod 65 includes an end tube 96 for pivotally receiving a pin 98*a* coupled to the upper end of the left bracket 84*a*. A lower end of end of each pivoting bracket 84*a*, 84*b* flanks an associated wheel 62 and includes an aperture 108 aligned with an aperture 110 of the associated wheels 62 for receiving an axle 66.

Figure 6:
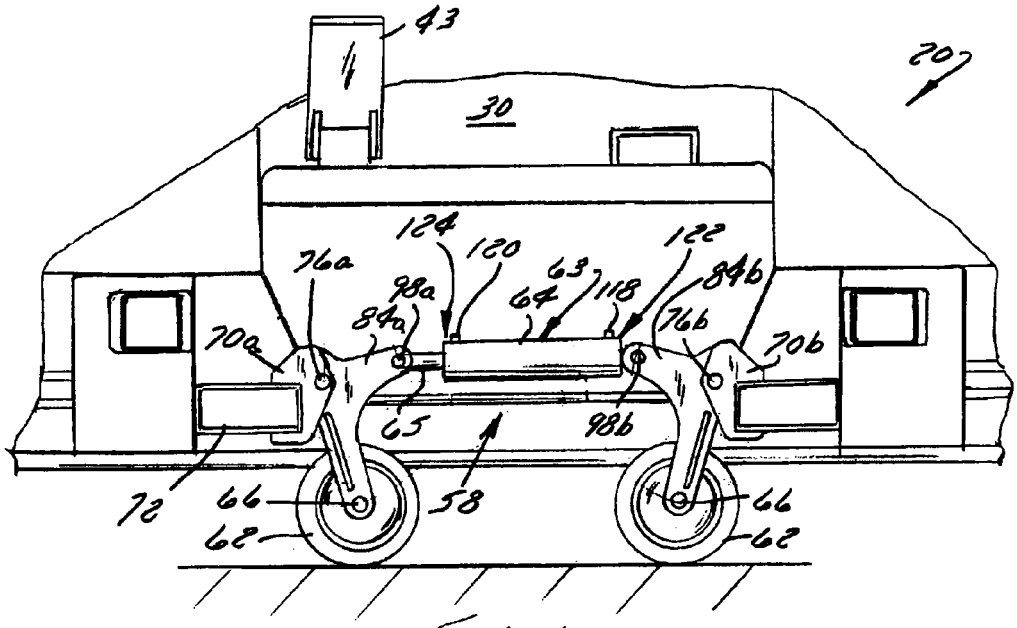
FIG. 6 is an elevational view of the transport system of FIG. 1, showing the wheel assembly in the lowered, deployed orientation.
Figure 7:
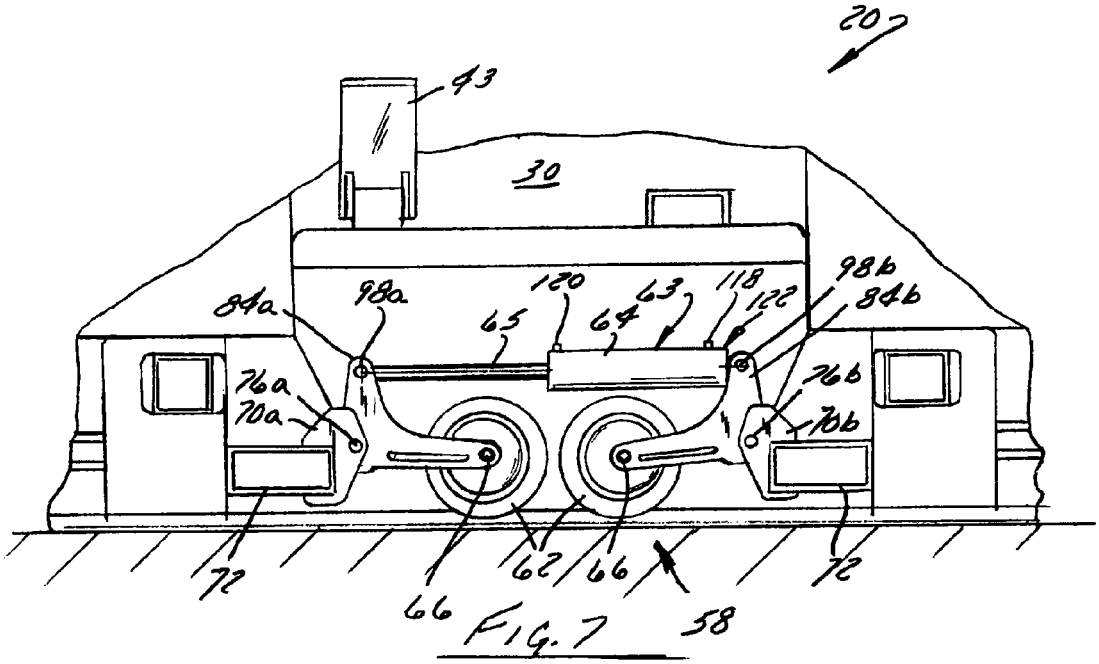
FIG. 7 is an elevational view like that of FIG. 6, showing the wheel assembly in the raised, stowed orientation.

Referring now to FIGS. 6-7, barrel 64 of hydraulic cylinder 63 includes a pair of ports 118, 120 on an upper side thereof in communication with an interior of barrel 64. Ports 118, 120 are configured to be coupled to the outlet of the pump of the hydrostatic drive system (not shown) as is generally understood in the art. In this manner, hydraulic fluid, such as oil, may be delivered to the barrel 64 and removed therefrom. Port 118 is positioned proximate a first end 122 of barrel 64 and port 120 is positioned proximate a second end 124 of barrel 64. First end 122 and second end 124 are separated from one another by the piston (not shown) carried by rod 65 as is generally understood.

Still referring to FIGS. 6 and 7, the wheel assembly 58 is shown in the lowered or deployed orientation and the raised, stowed orientation respectively. It is noted that the following discussion of the operation of wheel assembly 58 applies equally to wheel assembly 60. Referring first to FIG. 6, when the wheel assembly 58 is in the deployed orientation, the hydraulic cylinder 63 is in its retracted state such that the rod 65 extends partly out of barrel 64, and pivoting brackets 84 are biased such that the wheels 62 of each assembly are positioned on the ground and lift the trowel 20 from the ground so that the trowel 20 is fully supportable on the wheels 62. To move the wheels 62 to the stowed orientation, the operator actuates the switch 53 to extend the hydraulic cylinder 63 to rotate pivoting bracket 84*a* counterclockwise about pin 76*a* and to pivot bracket 84*b* clockwise about pin 76*b*. The wheels 62 thus are raised off the ground and moved into the stowed orientation as shown in FIG. 7.

To return the wheels 62 to the lowered, deployed orientation for transport of the trowel 20, the operator actuates switch 53 to retract the cylinder 63. Cylinder retraction pivots bracket 84*a* clockwise about pin 76*a* and pivots bracket 84*b* counterclockwise about pin 76*b* such that the wheels 62 are lowered into their deployed orientations and again lift the trowel 20 from the ground.

Accordingly, the wheel assemblies 58, 60 are movable via hydraulic cylinders 63 between a non-use, raised, or stowed orientation as shown in FIG. 7 and a deployed, lowered, or operational orientation as shown in FIG. 6. When the wheel assemblies 58, 60 are in the stowed orientation, the wheels 62 of wheel assemblies 58, 60 are located above the blades 44 so that the trowel 20 is supported on the blades 44. When supported on the blades 44, trowel 20 is capable of smoothing the underlying concrete surface. When the wheel assemblies 58, 60 are in the deployed orientation, the bottoms of the wheels 62 are positioned beneath the blades 44 so that the wheel assemblies 58, 60 lift the trowel 20 from the ground and support the weight of the trowel 20. When supported on the wheel assemblies 58, 60, trowel 20 is movable to another location for smoothing of another section of concrete, storage, lifting and transport, etc.

Hence, the inventive system reduces operator effort to configure the riding trowel for non-assisted transportation, provides an efficient means of changing the elevation of the machine and does not adversely affect the footprint of the trowel.

It should be mentioned that elevating trowel 20 with transport system 22 will also be beneficial for purposes other than transport. For instance, after a finishing operation, trowel 20, including the underside of cage 24 and blades 44, must be cleaned to remove residual concrete materials from the machine. Transport system 22 can be deployed to elevate trowel 20 such that a user can quickly clean the underside of the machine. In addition, the wheel assemblies 58, 60 can be deployed to facilitate blade maintenance or replacement or to facilitate the installation of pans on the bottoms of the rotor assemblies.

It is appreciated that a number of alternative arrangements are envisioned with respect to the transport system 22 of trowel 20. For instance, additional wheel assemblies could be provided at other locations on the trowel 20. The wheels of each assembly also could take any number of alternative configurations to that described above. In addition, each double acting cylinder could be replaced by a pair of single acting cylinders, one or more linear electric actuators, or other powered actuators entirely. The switch 53 also could be replaced by one or more switches, levers or other devices capable of controlling operation of one or more actuators.

It is appreciated that many changes and modifications could be made to the invention without departing from the spirit thereof. Some of these changes, such as its applicability to riding concrete finishing trowels having other than two rotor assemblies and even to other self-propelled powered finishing trowels, are discussed above. Other changes will become apparent from the appended claims. It is intended that all such changes and/or modifications be incorporated in the appending claims.

What is claimed is:

1. A transport system for a riding power trowel, the power trowel having a plurality of blades that are supported for rotation relative to a frame of the power trowel, and a cage that overlies and surrounds the blades, the transport system comprising front and rear wheel assemblies located in front of and behind a longitudinal centerline of the power trowel, respectively, each of the front and rear wheel assemblies comprising a first wheel and a second wheel located on opposite sides of a lateral centerline of the power trowel, respectively, a wheel support arrangement on which the first and second wheels are mounted, and a powered actuator arrangement that is actuatable to raise and lower the first and second wheels from a stowed position in which the wheels are located above the ground and the blades are supported on the ground to a deployed position in which the wheels are supported on the ground and the blades are raised from the ground and the power trowel is supported solely on the wheels, wherein the support arrangement of each of the front and rear wheel assemblies includes a first support assembly and a second support assembly coupled to the first wheel and the second wheel, respectively, each of the first support assembly and the second support assembly comprising a mounting bracket welded to a forklift tube of the frame of the power trowel and a pivoting bracket pivotally coupled to the mounting bracket at a first portion thereof and coupled to the respective wheel at a second portion thereof, and wherein each of the mounting brackets is welded to a forklift tube of the frame of the power trowel.

2. The transport system of claim 1, wherein the powered actuator arrangement of each of the front and rear wheel assemblies includes a hydraulic cylinder coupled between the first support assembly and the second support assembly, and wherein the hydraulic cylinder is configured to selectively pivot the pivoting brackets about the mounting brackets to position the first wheel and the second wheel in one of the deployed position and the stowed position.

3. The transport system of claim 2, wherein the hydraulic cylinder of each of the front and rear wheel assemblies comprises a barrel and a rod received through the barrel, wherein the rod is coupled to one of the first and second support assemblies and the barrel is coupled to the other of the first and second support assemblies.

4. The transport system of claim 1, wherein the transport system is positioned within a footprint of the power trowel.

5. The transport system of claim 4, wherein each of the wheel assemblies is positioned within the cage of the power trowel.

* * * * *